US010856613B2

(12) United States Patent
Bento et al.

(10) Patent No.: US 10,856,613 B2
(45) Date of Patent: Dec. 8, 2020

(54) GOLF SHOE WITH OUTSOLE HAVING FLEX CHANNELS AND WAVE-LIKE TRACTION MEMBERS

(71) Applicant: Acushnet Company, Fairhaven, MA (US)

(72) Inventors: Robert S. Bento, Raynham, MA (US); Daren S. Weddle, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 67 days.

(21) Appl. No.: 16/226,881

(22) Filed: Dec. 20, 2018

(65) Prior Publication Data

US 2020/0046072 A1 Feb. 13, 2020

Related U.S. Application Data

(63) Continuation-in-part of application No. 29/659,711, filed on Aug. 10, 2018, now Pat. No. Des. 871,740.

(51) Int. Cl.

| | |
|---|---|
| ***A43B 5/00*** | (2006.01) |
| ***A43B 13/22*** | (2006.01) |
| ***A43B 3/00*** | (2006.01) |
| ***A43C 15/02*** | (2006.01) |
| ***A43B 13/14*** | (2006.01) |
| ***A43C 15/16*** | (2006.01) |

(52) U.S. Cl.

CPC ..... *A43B 13/22* (2013.01); *A43B 3/0078* (2013.01); *A43B 5/001* (2013.01); *A43B 13/141* (2013.01); *A43B 13/223* (2013.01); *A43C 15/02* (2013.01); *A43C 15/16* (2013.01)

(58) Field of Classification Search

CPC ..... A43B 5/001; A43B 13/223; A43B 13/26; A43C 13/04; A43C 15/16

USPC ..... 36/127, 134, 59 R, 59 C

See application file for complete search history.

(56) References Cited

U.S. PATENT DOCUMENTS

| | | | | | |
|---|---|---|---|---|---|
| 1,604,583 | A | * | 10/1926 | Karpe | A43B 13/187 36/59 C |
| 2,207,401 | A | * | 7/1940 | Genecand | A43C 13/06 36/59 R |
| 4,559,723 | A | | 12/1985 | Hamy et al. | |
| 4,559,724 | A | * | 12/1985 | Norton | A43B 5/06 36/114 |
| 5,423,135 | A | * | 6/1995 | Poole | A43B 13/223 36/116 |
| 5,699,628 | A | * | 12/1997 | Boatwalla | A43B 5/007 36/59 C |
| 5,709,954 | A | * | 1/1998 | Lyden | A43B 5/00 12/142 R |
| 5,979,083 | A | | 11/1999 | Robinson et al. | |

(Continued)

*Primary Examiner* — Marie D Bays

(74) *Attorney, Agent, or Firm* — Daniel W. Sullivan

(57) ABSTRACT

Golf shoes having improved outsole constructions are provided. The outsole contains flex channels that provide flexibility when a person is walking or playing a golf course. The outsole further includes traction members having a serrated, wave-like structure. These traction members make high contact with the ground surface and provide high traction, stability, and support for the golfer. The outsole may further include removable spikes that are fastened to receptacles. These spikes can be arranged in different patterns and they provide additional support and traction.

13 Claims, 7 Drawing Sheets

(56) References Cited

U.S. PATENT DOCUMENTS 6,161,315 A * 12/2000 Dalton ..... A43B 5/001 36/134
6,276,073 B1 * 8/2001 Curley, Jr. ..... A43B 5/001 36/127
6,289,611 B1 8/2001 Patterson et al.
6,708,426 B2 3/2004 Erickson et al.
D496,779 S * 10/2004 Belley ..... A43B 13/223 D2/953
7,143,529 B2 12/2006 Robinson, Jr. et al.
D552,333 S * 10/2007 McClaskie ..... A43B 13/223 D2/953
7,650,707 B2 * 1/2010 Campbell ..... A43B 3/0057 36/102
7,895,773 B2 * 3/2011 Robinson, Jr. ..... A43B 3/0078 36/127
8,418,382 B2 * 4/2013 Madore ..... A43B 13/141 36/102
8,533,979 B2 * 9/2013 Baker ..... A43B 13/12 36/59 R
2006/0130361 A1 * 6/2006 Robinson, Jr. ..... A43B 23/24 36/25 R
2006/0242863 A1 * 11/2006 Patmore ..... A43B 13/26 36/127
2008/0282579 A1 * 11/2008 Bobbett ..... A43B 13/026 36/127
2010/0083536 A1 * 4/2010 Barrow ..... A43B 3/24 36/100
2010/0281714 A1 * 11/2010 Carboy ..... A43B 13/14 36/25 R
2011/0197478 A1 * 8/2011 Baker ..... A43C 15/14 36/59 R
2014/0123522 A1 * 5/2014 Rustam ..... A43B 7/144 36/127
2014/0144050 A1 * 5/2014 Smith, III ..... A43B 13/00 36/137
2015/0096195 A1 * 4/2015 Bacon ..... A43B 13/141 36/87
2015/0366289 A1 * 12/2015 Rustam ..... A43B 5/001 36/127

* cited by examiner

GOLF SHOE WITH OUTSOLE HAVING FLEX CHANNELS AND WAVE-LIKE TRACTION MEMBERS

CROSS-REFERENCE TO RELATED APPLICATIONS

This application is a continuation-in-part of co-pending, co-assigned U.S. patent Ser. No. 29/659,711, filed on Aug. 10, 2018, the entire disclosure of which is hereby incorporated by reference.

BACKGROUND OF THE INVENTION

Field of the Invention

The present invention relates generally to golf shoes and, more particularly, to golf shoes having improved outsoles. The outsole contains flex channels that provide flexibility when a person is walking or playing a golf course. The outsole further includes traction members having a serrated, wave-like structure. These traction members make high contact with the ground surface and provide high traction, stability and support for the golfer.

Brief Review of the Related Art

Both professional and amateur golfers use specially designed golf shoes today. Typically, the golf shoe includes an upper portion and outsole portion along with a mid-sole that connects the upper to the outsole. The upper has a traditional shape and is made from a standard upper material such as leather. The material used to construct the upper is selected based on desired properties such as breathability, durability, flexibility, and comfort. The mid-sole is relatively lightweight and provides cushioning to the shoe. The mid-sole is made from a material such as ethylene vinyl acetate copolymer (EVA). The outsole is designed to provide stability, support, and traction for the shoe. The bottom surface of the outsole typically includes various traction elements such as spikes or cleats to help provide traction between the shoe and ground.

The golf shoe needs to provide sufficient stability and support for the golfer. Thus, many golf shoes have an outsole made of a relatively rigid material such as thermoplastic polyurethane. This material helps provide stiffness and rigidity to the shoe. At the same time, the shoe should be constructed so that it is not overly rigid. The golf shoe needs to have sufficient flexibility. The foot needs to bend during walking and when swinging the golf club. The golf shoe industry has looked at different ways for improving the flexibility of the shoe, while maintaining high stability and support.

For example, U.S. Pat. No. 7,895,773 to Robinson, Jr. et al. discloses a golf shoe comprising an upper, a midsole, and an outsole, wherein a collapsible support element is positioned in a recess of the outsole and close to the first metatarsal bone of the foot. The collapsible support element comprises a collapsible gel pad encased in thermoplastic urethane, or a single collapsible element, or a series of collapsible elements. The collapsible element is stiffer in a longitudinal direction and more collapsible in a transverse direction. This helps minimize the impact of ground forces when the golfer is walking, and allows for more efficient transfer of energy during a golf swing.

U.S. Pat. No. 7,143,529 to Robinson, Jr. et al., and U.S. Pat. No. 6,708,426 to Erickson et al., disclose golf shoes having an outsole including a forward portion and a rearward portion that are connected by a ball-and-socket connection that allows the portions to move freely. The outsole may include flexible members disposed between discrete pieces of the forward portion to allow these pieces to flex freely. The outsole also may include a pair of stabilizer rods. The outsole allows for individual movement of the foot, particularly, the rotation between the rearfoot and the forefoot. This helps resist torsional instability during play, provides independent traction suspension, and increases the flexibility of the shoe.

U.S. Pat. No. 5,979,083 to Robinson, Jr. et al. discloses a golf shoe having a two-layered outsole including an outer layer and an inner layer made from thermoplastic compositions. The outer layer forms the bottom of the outsole and has a plurality of first holes at spaced locations there through. The inner layer includes a base adjacent one side of the outer layer and a plurality of projections that extend from the base through the first holes in the outer layer, and terminate in a pointed free end. The projections protrude from the bottom of the outsole, and provide traction when the outsole interacts with the ground. The shoe is constructed such that it provides adequate traction during a golf swing and minimizes damage to the turf of golf courses during play.

Although some of the above-described shoes have been somewhat effective in providing sufficient rigidity as well as flexibility, there is a need for an improved outsole. The outsole should provide sufficient rigidity without sacrificing flexibility. A person wearing the shoe should be able to walk comfortably and have sufficient support. The shoe should also hold and support the medial and lateral sides of the golfer's foot as they shift their weight when making a shot. There remains a need for a golf shoe that provides a golfer with sufficient traction, comfort, and support. The present invention provides such a golf shoe having these features as well as other advantageous properties, features, and benefits.

SUMMARY OF THE INVENTION

The present invention relates to golf shoes comprising an upper; an outsole; and a midsole connected to the upper and outsole. The upper, midsole, and outsole each have forefoot, mid-foot, and rear-foot regions with lateral and medial sides. The outsole includes a plurality of protruding traction members and flex channels. Each flex channel is disposed between a set of anterior and posterior traction members. The flex channels and traction members extend in a substantially transverse direction. The flex channels have a linear channel structure and the traction members have a sine-wave structure. A plurality of receptacles can be integrated into the outsole for selectively attaching a plurality of removable spikes. The provides good structural rigidity without sacrificing flexibility and comfort.

The flex channels and traction members can have various dimensions. For example, the lengths of the anterior and posterior traction members in a given set can be greater the length of the flex channel that is disposed between the anterior and posterior traction members of that set. In one particular embodiment, the anterior and posterior traction members have a length in the range of about 14 to about 85 mm; and the flex channel has a length in the range of about 8 to about 40 mm. In one embodiment, the flex channel has a depth of about 2 mm. The sine-wave, serrated structure of the traction members can vary. For example, the traction members can contain at least two wave peaks, wherein the height of the peaks is in the range of about 2 to about 4 mm.

In one embodiment, a first portion of traction members contains three wave peaks, and a second portion of traction members contains four wave peaks. The outsole can contain additional protruding traction members, for example, cone-shaped and triangular-shaped members. Also, the outsole can contain grooves in certain areas of the outsole, and shoe logos may be imprinted in these areas.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
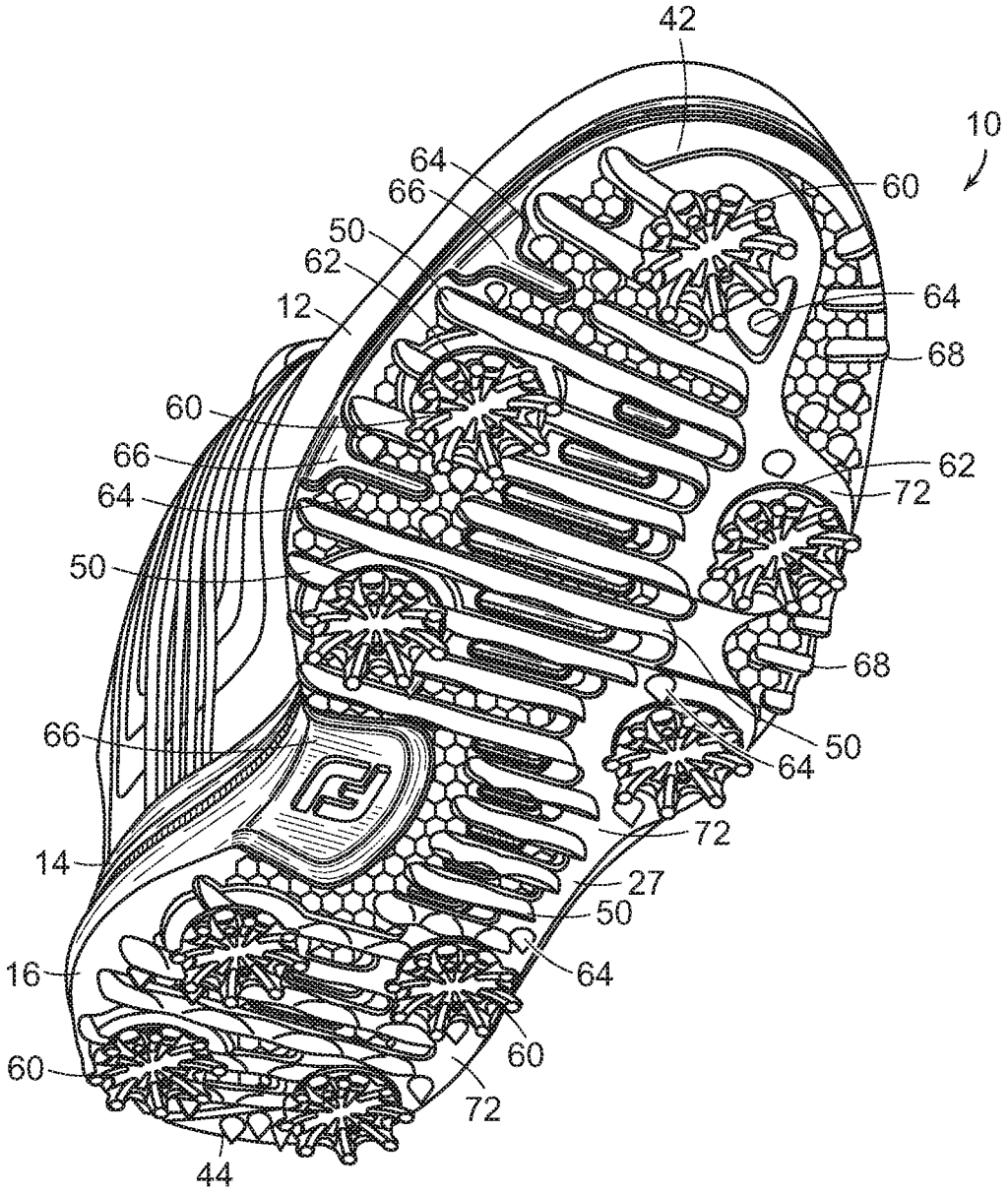
FIG. 1 is a perspective view of one embodiment of a golf shoe of the present invention showing the outsole in detail.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The views shown in the Figures are of a left shoe and it is understood the components for a right shoe will be mirror images of the left shoe. It also should be understood that the shoe may be made in various sizes and thus the size of the components of the shoe may be adjusted depending upon the shoe size.

Figure 2:
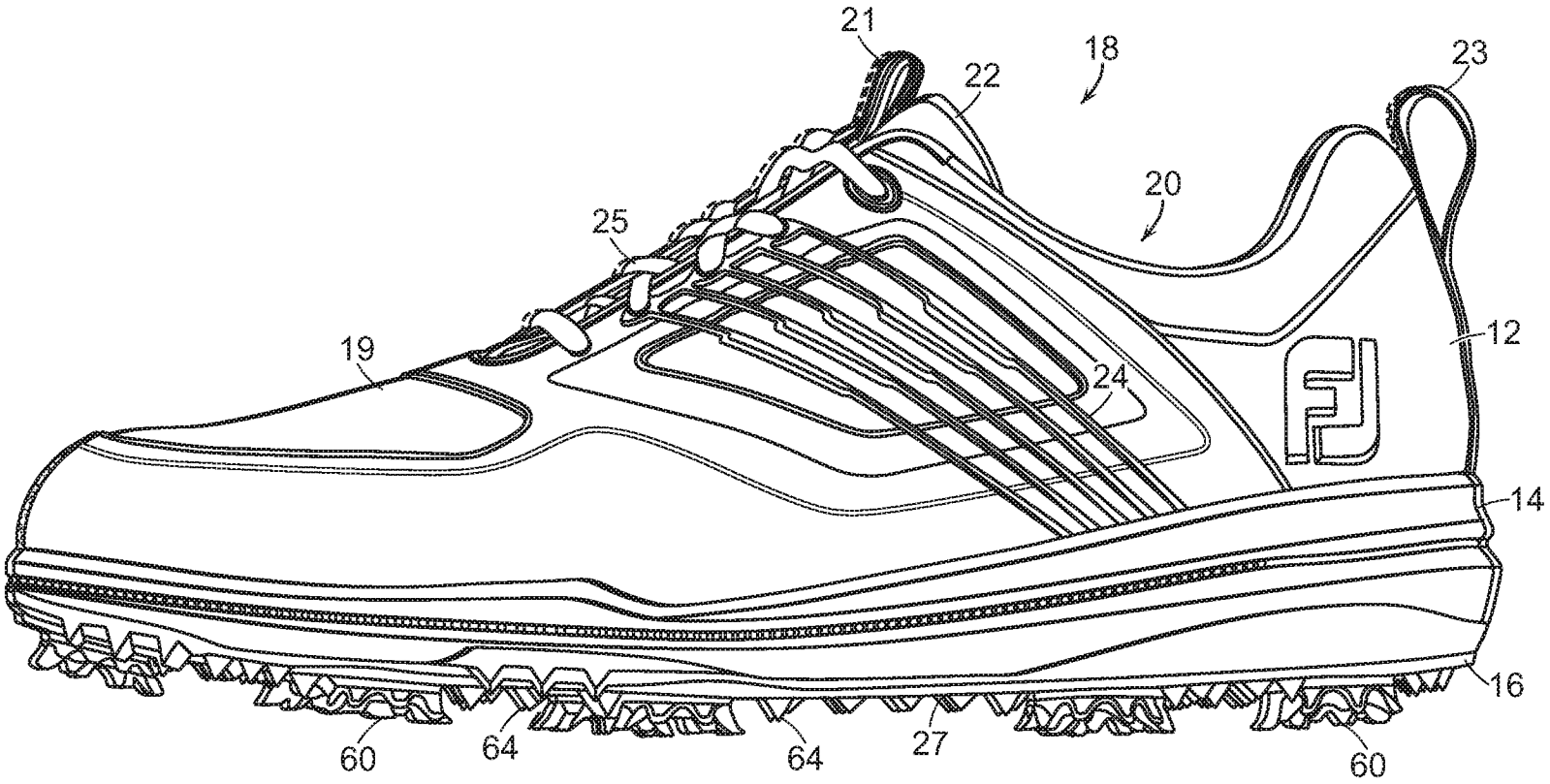
FIG. 2 is a lateral side view of one embodiment of a golf shoe of the present invention showing the upper in detail.

The upper (12) has a traditional shape and is made from a standard upper material such as, for example, natural leather, synthetic leather, non-woven materials, natural fabrics, and synthetic fabrics. For example, breathable mesh, and synthetic textile fabrics made from nylons, polyesters, polyolefins, polyurethanes, rubbers, and combinations thereof can be used. For example, a thermoplastic polyurethane hot-melt material may overlay a mesh material. The materials used to construct the upper are selected based on desired properties such as breathability, durability, flexibility, and comfort. The upper materials are stitched or bonded together to form an upper structure. Referring to FIG. 2, the upper (12) generally includes an instep region (18) with an opening (20) for inserting a foot. The upper includes a vamp (19) for covering the forepart of the foot. The instep region includes a tongue member (22) with an optional tongue ghille strip (21). The upper (12) may include an optional ghille strip (23) extending from the rear of the instep region (18). The upper (12) also may include stylish stripe segments (24) made of thermoplastic polyurethane or other suitable material that overly the saddle area. Normally, laces (25) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc., Denver, Colo. 80216.

It should be understood that the above-described upper (12) shown in FIGS. 1 and 2 represents only one example of an upper design that can be used in the shoe construction of this invention and other upper designs can be used without departing from the spirit and scope of this invention.

The midsole (14) is relatively lightweight and provides cushioning to the shoe. The midsole (14) can be made from a standard midsole material such as, for example, foamed ethylene vinyl acetate copolymer (EVA) or polyurethane. In one manufacturing process, the midsole (14) is molded on and about the outsole. Alternatively, the midsole (14) can be molded as a separate piece and then joined to the top surface (not shown) of the outsole (16) by stitching, adhesives, or other suitable means using standard techniques known in the art. For example, the midsole (14) can be heat-pressed and bonded to the top surface of the outsole (16).

In general, the outsole (16) is designed to provide stability and traction for the shoe. The bottom surface (27) of the outsole (16) includes multiple traction members (50) to help provide traction between the shoe and the golf course turf. These traction members (50) have different shapes and sizes as discussed further below. The bottom surface (27) of the outsole and traction members (50) can be made of any suitable material such as rubber or plastic and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. The structure and functionality of the outsole (16) of the present invention is described in further detail as follows.

Regions of the Outsole

Figure 3:
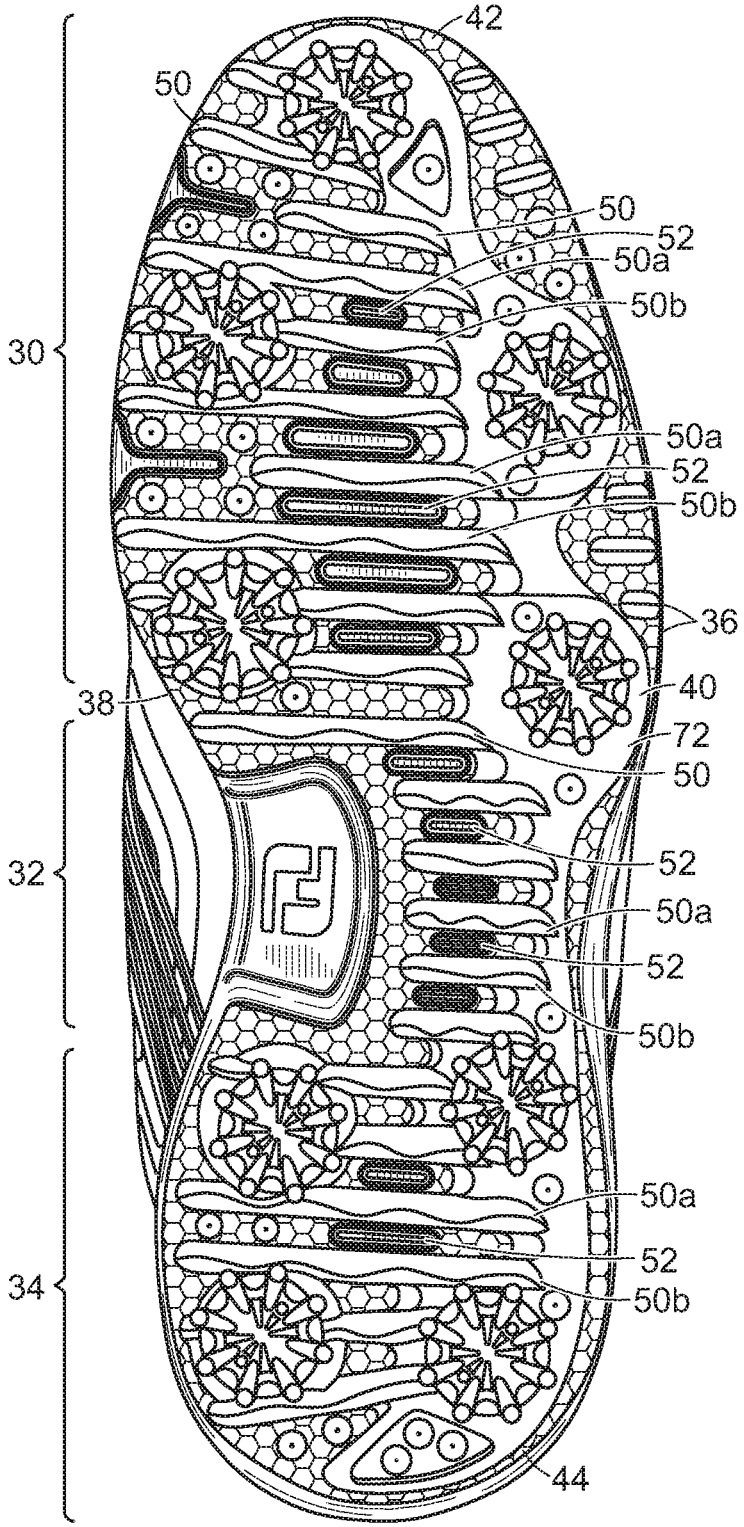
FIG. 3 is a bottom plan view of the outsole of the golf shoe shown in FIG. 1.

In general, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. Turning to FIG. 3, the outsole (16) generally includes a forefoot region (30) for supporting the forefoot area; a mid-foot region (32) for supporting the mid-foot including the arch area; and rearward region (34) for supporting the rear-foot including heel area. In general, the forefoot region (30) includes portions of the outsole corresponding with the toes and the joints connecting the metatarsals with the phalanges. The mid-foot region (32) generally includes portions of the outsole corresponding with the arch area of the foot. The rear-foot region (34) generally includes portions of the outsole corresponding with rear portions of the foot, including the calcaneus bone.

The outsole also includes a lateral side (36) and a medial side (38). Lateral side (36) and medial side (38) extend through each of the foot regions (30, 32, and 34) and correspond with opposite sides of the outsole. The lateral side or edge (36) of the outsole is the side that corresponds with the outer area of the foot of the wearer. The lateral edge (36) is the side of the foot of the wearer that is generally farthest from the other foot of the wearer (that is, it is the side closer to the fifth toe [little toe].) The medial side or edge (38) of the outsole is the side that corresponds with the inside area of the foot of the wearer. The medial edge (38) is the side of the foot of the wearer that is generally closest to the other foot of the wearer (that is, the side closer to the hallux [big toe].)

More particularly, the lateral and medial sides extend around the periphery or perimeter (40) of the outsole (16) from the anterior end (42) to the posterior end (44) of the outsole. The anterior end (42) is the portion of the outsole corresponding to the toe area, and the posterior end (44) is the portion corresponding to the heel area. Measuring from the lateral or medial edge of the outsole in a linear direction towards the center area of the outsole, the peripheral area generally has a width of about 3 to about 6 mm. The width of the periphery may vary along the contour of the outsole and change from the forefoot to mid-foot to rear-foot regions (30, 32, and 34).

The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

Traction Members and Flex Channels

As further shown in FIG. 3, the forefoot region (30) of the outsole includes a plurality of traction members (50) and a plurality of flex channels (52) both extending in a substantially transverse direction. The flex channels (52) are disposed between a set of anterior and posterior traction members (50*a*, 50*b*). That is, a flex channel (52) is sandwiched between two neighboring traction members (50*a*, 50*b*) in a given set. These traction members (50) protrude from the bottom surface of the outsole to contact the ground. The traction members (50) help provide good stability and traction for the golfer when he/she is walking and playing the course as discussed further below. The flex channels (52) have a generally linear channel structure and the traction members (50) have a generally serrated, wave-like structure.

For a set of anterior and posterior traction members (50*a*, 50*b*) and adjacent flex channel (52), the lengths of both the anterior and posterior traction members (LTM1 and LTM2), are greater than the length of the flex channel (LFC1). For example, the length of the traction members (50) can be in the range of about 10 to about 90 mm, and preferably in the range of about 14 to about 85 mm. In one preferred embodiment, the length of the traction members (50) is in the range of about 20 to about 80 mm. In another preferred embodiment, the length of the traction members (50) is in the range of about 27 to about 32 mm. In one embodiment, for a given set of anterior and posterior traction members (50*a*, 50*b*), the lengths of the anterior and posterior traction members (50*a*, 50*b*) are substantially the same. In another embodiment, for a given set of anterior and posterior traction members (50*a*, 50*b*), the length of the anterior traction member (50*a*) is greater than the length of the posterior traction member (50*b*). In yet another embodiment, for a given set of anterior and posterior traction members (50*a*, 50*b*), the length of the posterior traction member (50*b*) is greater than the length of the anterior traction member (50*a*).

Figure 4:
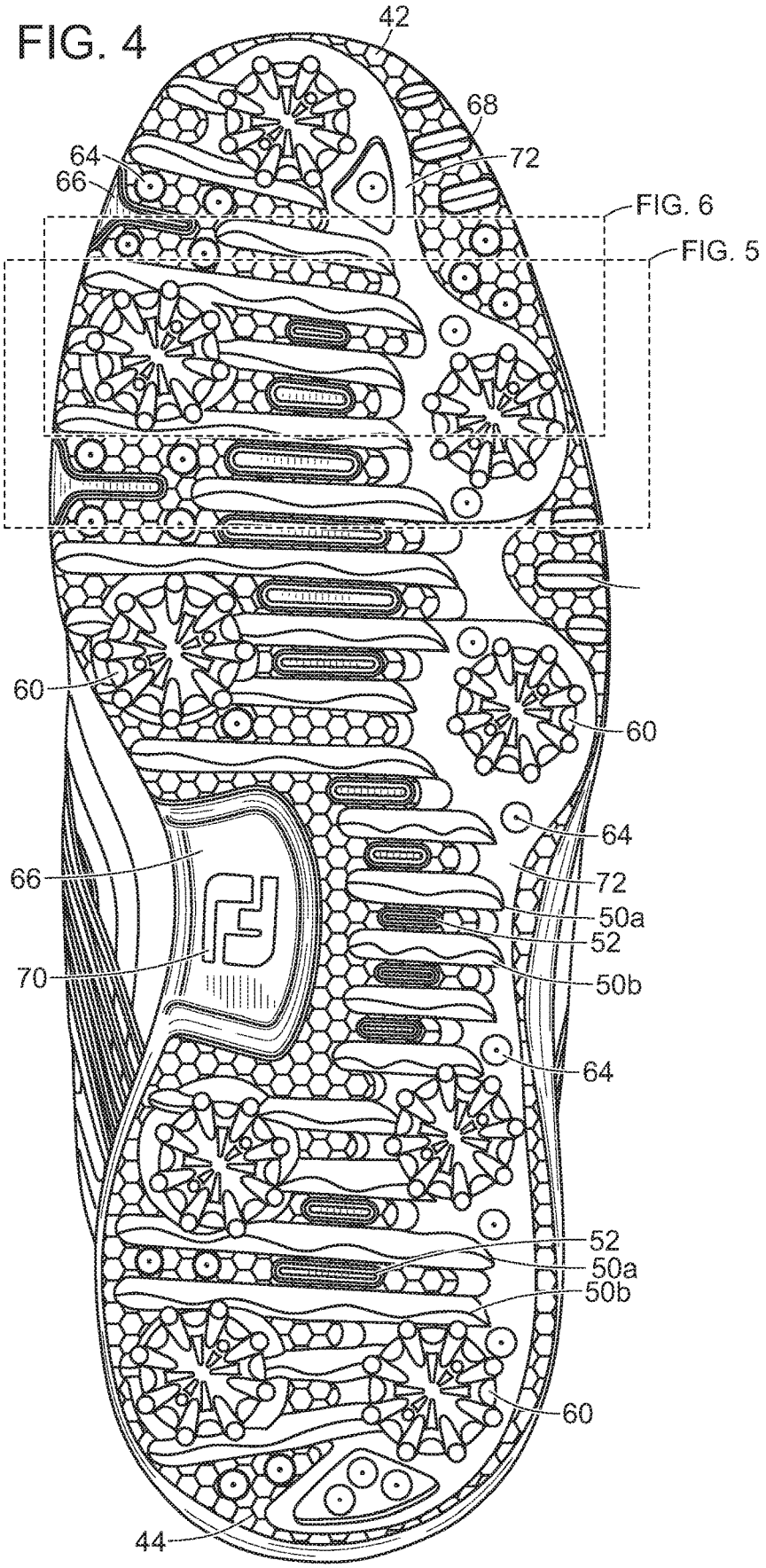
FIG. 4 is an enlarged view of the outsole of the golf shoe shown in FIG. 3.
Figure 5:
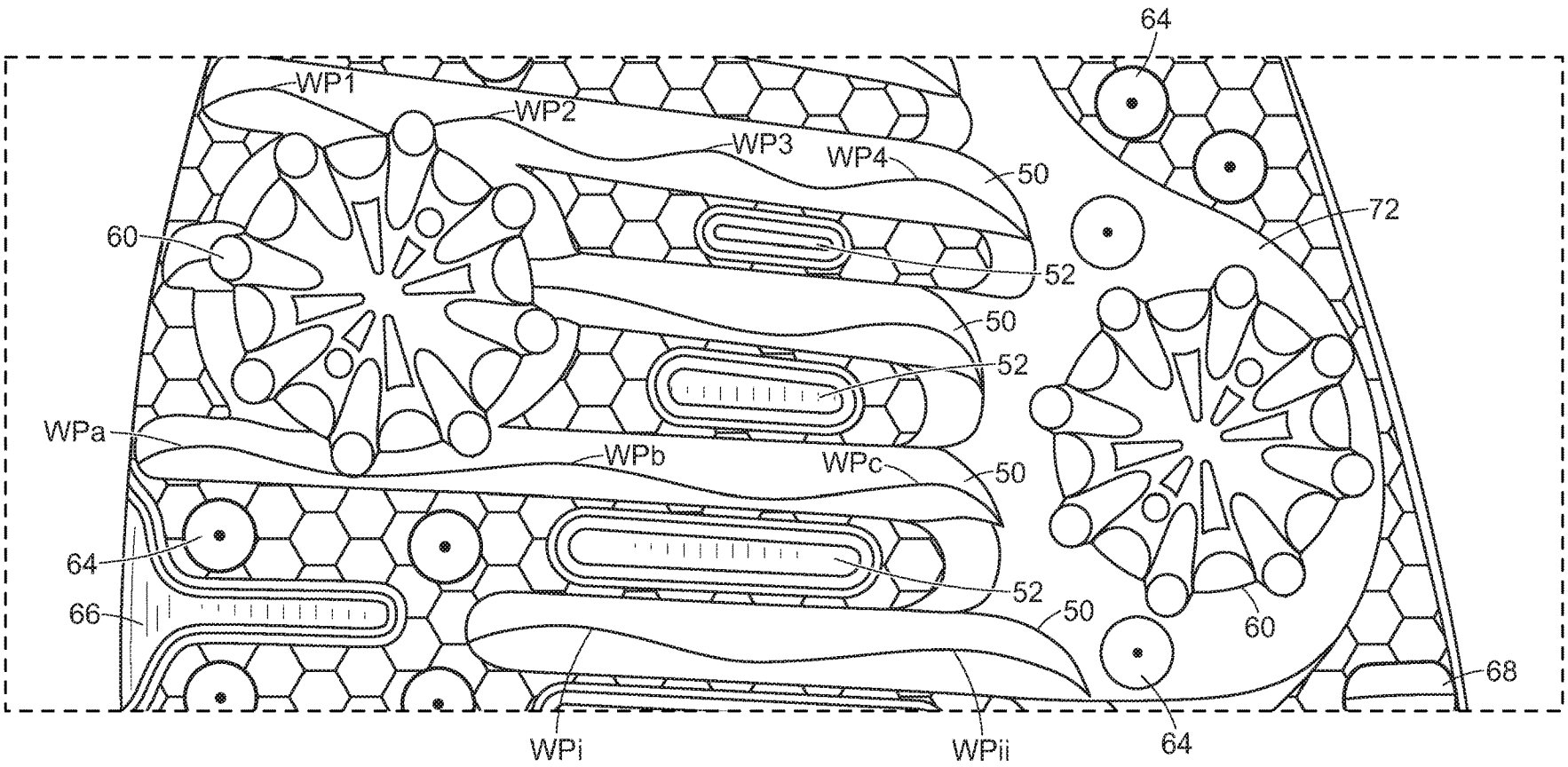
FIG. 5 is an enlarged view of one portion of the outsole of the golf shoe shown in FIG. 4.

Referring to FIGS. 4 and 5, close-up views of the traction members (50) and flex channels (52) are shown. The flex channels (52) normally have a length in the range of about 8 to about 40 mm. In one preferred embodiment, the length of the flex channels (52) is in the range of about 10 to about 30 mm. The flex channels (52) normally have a depth in the range of about 1.5 to about 2.5 mm. In one preferred embodiment, the depth of the flex channels (52) is about 2 mm. The flex channels (52) normally have a width in the range of about 2 to about 8 mm. In one preferred embodiment, the width is about 4 to about 6.5 mm. Further, the total number of flex channels (52) and traction members (50) may vary depending on the desired flexibility and traction of the outsole and size of the shoe. Similarly, the length, width, depth, and shape of the flex channels (52) and traction members (50) may be adjusted.

As shown in FIGS. 4 and 5, the traction members (50) have a serrated pattern. In other words, the traction members (50) have a sinusoidal wave structure with a repeating pattern of wave peaks. The amplitude of the wave (height of the peaks) is preferably in the range of about 2 to about 4 mm. The wavelength (distance from peak to peak along the wave pattern of the traction member) can vary. In general, the distance between wave peaks in the traction member (50) is normally in the range of about 10 to about 50 mm. For example, when there are three (3) wave peaks in the traction member (50), the distance between peaks may be in the range of about 28 to about 34 mm. Referring to FIG. 5, a traction member (50) with three wave peaks (WPa, WPb, and WPc) is shown, wherein the distance between wave peaks, WPa and WPb, is about 30 mm. In another example, when there are four wave peaks, the distance may be in the range of about 16 to about 24 mm. As further shown in FIG. 5, a traction member (50) with four wave peaks (WP1, WP2, WP3, and WP4) is provided, wherein the distance between wave peaks, WP2 and WP3 is about 18 mm. In yet another example, a traction member (50) with only two wave peaks (WPi and WPii) is shown. The peak-to-peak distance within the wave structure of the traction member (50) can vary. For example, for a given traction member (50), the distance between two adjacent peaks can be 23.5 mm and the distance between two other adjacent peaks in the same traction member can be 21.5 mm.

Figure 6:
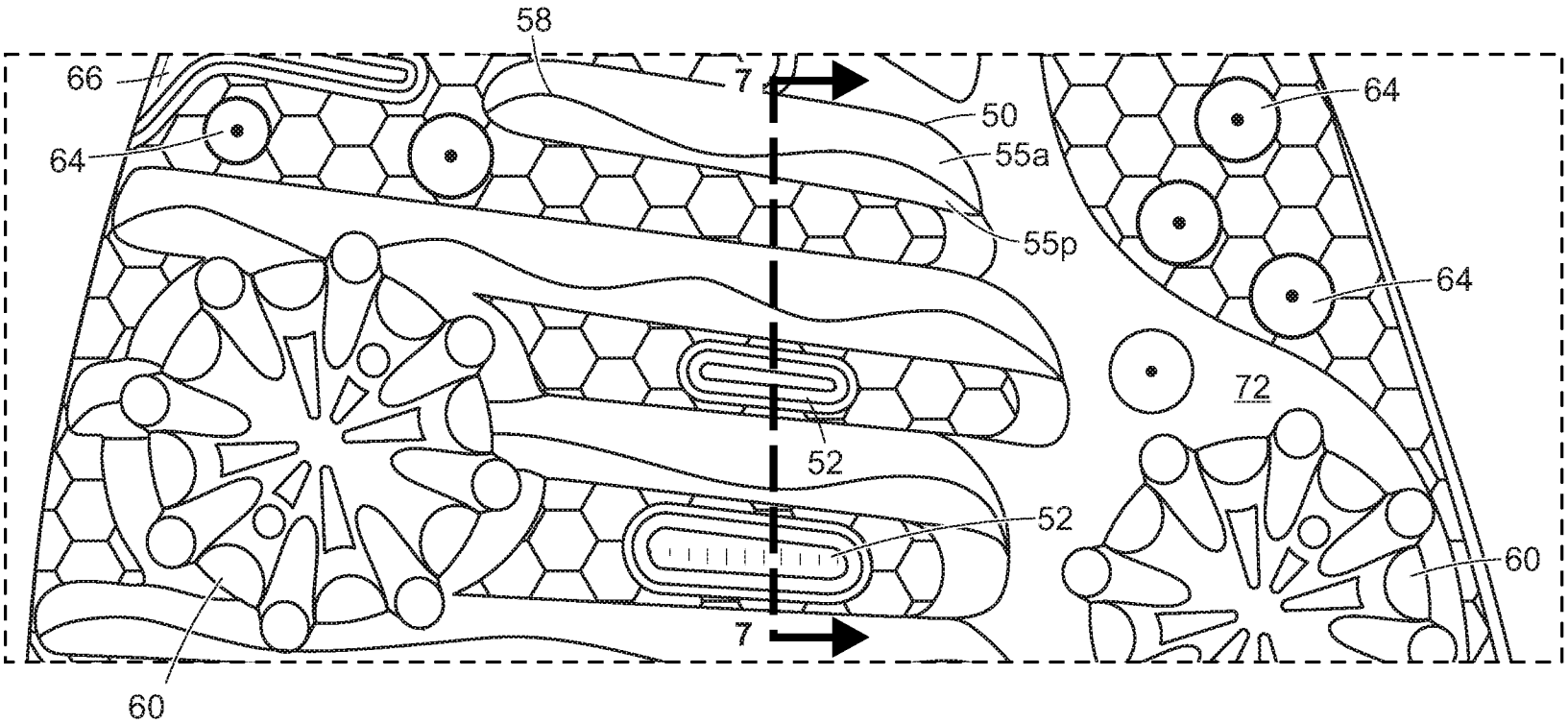
FIG. 6 is an enlarged view of a second portion of the outsole of the golf shoe shown in FIG. 4.
Figure 7:
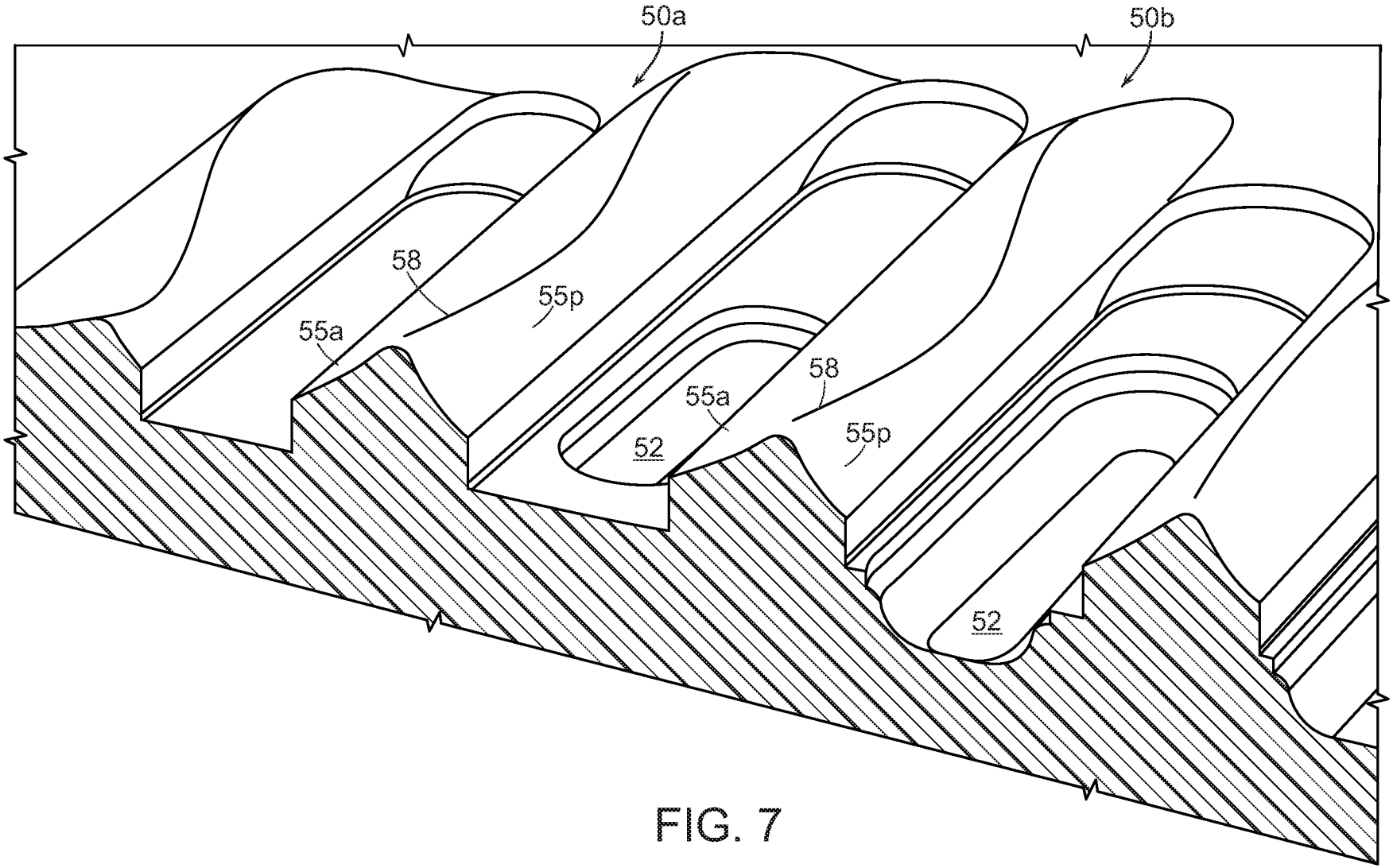
FIG. 7 is a cross-sectional view of the outsole section taken along Line 7-7 in FIG. 6.

Referring to FIGS. 6 and 7, the radius of curvature of the different sections of a single traction member (50) also can vary. The posterior portion (55*p*) of a traction member (50) is the section facing the posterior end (44) of the outsole; and the anterior portion (55*a*) is the section facing the anterior end (42) of the outsole. For example, the radius of curvature can be about 5 mm on the posterior section (55*p*) of a given traction member (50). Meanwhile, the radius of curvature can be about 20 mm on the anterior section (55*a*) of the same traction member (50). That is, in this example, the posterior portion (55*p*) has more area carved-out (radius of curvature of about 5 mm) than the anterior portion (55*a*) (radius of curvature of about 20 mm) of the given traction member (50). The posterior portion (55*p*) has a more scallop shell-like shape as opposed to the anterior portion (55*a*) which has a flatter shape. If the radius of curvature of the posterior portion (55*p*) was 3 mm, it would mean that even more area in the posterior portion was carved-out and it would have deeper shell-like shape. Further, the radius of curvature on the top (break) edge (58) of the traction member (50) is preferably in the range of about 0.20 to about 1.00 mm; and in one particular embodiment, is about 0.5 mm.

The above-described traction members (50) are particularly effective in providing maximum contact with the ground to help prevent a person from slipping and losing their balance when walking or swinging a golf club. The carved-out areas (55*p*, 55*a*, 58) of the traction members (50) help provide high surface area contact with the ground and prevents the outsole from slipping and sliding. The carved-out areas of the traction members (50) have good turf-grabbing action. These high traction properties are particularly important when a golfer is planting his/her feet on the course turf and swinging the club.

For example, when a golfer is first planting his/her feet before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important that both the front and back feet do not substantially move or slip when making the shot. Good foot traction is important during all phases of the golf shot cycle. The golf shoes of the present invention with these traction members are particularly effective in providing a high turf-grabbing action to prevent slipping and sliding when walking or swinging the club.

Referring back to FIG. 1, the bottom surface (27) of the outsole (16) may further include spikes or cleats (60). Often, the terms, "spikes" and "cleats" are used interchangeably in the golf industry. Some golfers prefer the term, "spikes," since cleats are more commonly associated with other sports such as baseball, football, and soccer. Other golfers like to use the term, "cleats" since spikes are more commonly associated with non-turf sports such as track or bicycling. In the following description, the term, "spikes" will be used for convenience purposes. Golf shoe spikes can be made of a metal or plastic material. However, one problem with metal spikes is they are normally elongated pieces with a sharp point extending downwardly that can break through the surface of the putting green thereby leaving holes and causing other damage. These metal spikes also can cause damage to other ground surfaces at a golf course, for example, the carpeting and flooring in a clubhouse. Today, most golf courses require that golfers use non-metal spikes.

If spikes (60) are present on the golf shoe (10), they are preferably made from a plastic material and releasably fastened to receptacles (sockets) (62) in the outsole (16). These plastic spikes, which can be easily fastened and later removed from the locking receptacle on the outsole, tend to cause less damage to the greens and clubhouse flooring surfaces. The outer rim of the receptacles (62) can be seen in FIG. 1. Plastic spikes normally have a rounded base with a central stud on one face. On the other face of the rounded base, there are radial arms with traction projections for contacting the ground surface. Screw threads are spaced about the stud on the spike for inserting into the threaded receptacle (62). The receptacle (62) may be located in a molded pod (not shown) attached to the outsole (16). The molded pod helps provide further stability and balance to the shoe. The spike (60) may be inserted and removed easily from the receptacle (62). Normally, the spike (60) may be secured in the receptacle (62) by inserting it and then slightly twisting it in a clockwise direction. The spike (60) may be removed from the receptacle (62) by slightly twisting it in a counter-clockwise direction. The outsole (16) may include any suitable amount of spikes (60), and the spikes can be arranged in a wide variety of patterns. In the example of the shoe (10) shown in FIG. 1, the outsole (16) contains nine (9) spikes (60). Preferably, the outsole includes five (5) to nine (9) spikes that may be arranged in various patterns. Such spikes are commercially-available from various manufacturers such as Softspikes, LLC, a division of Pride Manufacturing LLC. (Brentwood, Tenn.).

Also, as shown in FIG. 1, the bottom surface (27) of the outsole (16) may further include conical traction projections (64) for providing additional traction with the ground surface. The traction projections (64) may have any suitable shape including, but not limited to, rectangular, triangular, square, spherical, star, diamond, pyramid, arrow, conical, and rod shapes. Also, the height and area of the traction projections (64) may be the same or different. Additionally, in some areas, grooves (66) run along the medial edge (38) of the outsole adjacent to the traction members (50) and conical traction projections (64). These grooves (66) provide additional flexibility. Also, in some embodiments, triangular-shaped traction members (ridges) (68) run along the lateral edge (36) of the outsole (16) to provide additional traction between the outsole and ground surface. A logo (70) may be positioned in the substantially-rectangular-shaped grove (66) running along the arch portion of the outsole (16). One preferred material for forming the visible logo (70) is thermoplastic polyurethane.

Properties of Outsole

The flex channels (52) allow the outsole (16) to flex and bend when a person wearing the shoe walks or swings a club. These flex channels (52) allow the outsole to fold around a given channel and therefore provides for bending around the axis created by that channel. The relatively hard base material (72), for example, thermoplastic polyurethane, used to form the outsole provides stiffness to the outsole (16). The hard base material (72) helps to resist bending and provides support and stability. Therefore, when a golfer walks, and shifts their weight between their heel and toe, the outsole (16) bends around the flex channels (52) to provide comfort to the user, but the shoe remains structurally stable. Also, as described above, the above-described traction members (50) are particularly effective in providing maximum contact with the ground to help prevent a person from slipping and losing their balance when walking or swinging a golf club. These traction members (50) have high turf-grabbing strength and help to provide stability and support. Less bending and flexing is needed in the far anterior and posterior ends (42, 44) of the outsole (16)—that is, tips of the forefoot and rear-foot regions (30, 34); so in some embodiments, these areas may contain no flex channels (52). Rather, these anterior and posterior areas may consist entirely of the hard base material (72). In addition, these anterior and posterior areas (42, 44) may contain traction members (50), triangular-shaped traction ridges (68), and conical traction projections (64) as shown in FIGS. 1-4.

The relatively hard base material (72) used to make the outsole (16) helps provide stiffness and stability to the shoe (10). The hard base material (72) may be formed from one or more materials such as thermoplastic polyurethane or the like, and normally has a hardness in the range of about 60 to about 90 Shore A. In one embodiment of the golf shoe (10), as shown in the Figures, two different thermoplastic polyurethane materials are used to construct the base of the outsole (16). As discussed above, the hard base material (72)

does not constitute the entire outsole (16) of the shoe. Rather, as shown in the Figures, the outsole (16) also includes flex channels (52). The flex channels are made of a relatively soft material such as ethylene vinyl acetate copolymer (EVA). In one preferred embodiment, the flex channels (52) comprise the same EVA or other material used to make the midsole (14) of the shoe (10). The exposed midsole areas (14) of the shoe form the flex channels (52). The midsole (that is, the flex channels) is plainly visible to a person looking at the outsole (16) of the shoe. The outsole (16) also includes the traction members (50) and may include receptacles (62) for releasably fastening spikes (60) as discussed above.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "right", "left", "middle" "proximal", "distal", "lateral", "medial", "anterior", "posterior", and the like are arbitrary terms used to refer to one position of an element based on one perspective and should not be construed as limiting the scope of the invention.

It is understood that the shoe materials and constructions described and illustrated herein represent only some embodiments of the invention. It is appreciated by those skilled in the art that various changes and additions can be made to materials and constructions without departing from the spirit and scope of this invention. It is intended that all such embodiments be covered by the appended claims.

We claim:

1. A golf shoe comprising:

an upper, an outsole, and a midsole connected to the upper and outsole, the upper, midsole, and outsole each having forefoot, midfoot, and rear-foot regions and lateral and medial sides; and the outsole comprising a plurality of traction members, a plurality of flex channels, each flex channel being disposed between a set of anterior and posterior traction members, the flex channels and traction members extending in a substantially transverse direction, wherein the flex channels have a linear channel structure and the traction members have a sine-wave structure, wherein the lengths of both the anterior and posterior traction members in a given set of traction members are greater than the length of the flex channel that is disposed between the anterior and posterior traction members of that set.

2. The golf shoe of claim 1, wherein the lengths of both the anterior and posterior traction members are in the range of about 14 to about 85 mm and the length of the flex channel is in the range of about 8 to about 40 mm.

3. The golf shoe of claim 1, wherein the depth of the flex channel is about 2 mm.

4. The golf shoe of claim 1, wherein the sine-wave structure for each of the anterior and posterior traction members contains at least two wave peaks.

5. The golf shoe of claim 4, wherein the height of the peaks is in the range of about 2 to about 4 mm.

6. The golf shoe of claim 4, wherein the distance between the peaks is in the range of about 10 to about 50 mm.

7. The golf shoe of claim 4, wherein the sine-wave structure for the traction members contains two, three, or four wave peaks.

8. The golf shoe of claim 1, further comprising a plurality of cone-shaped traction members extending along the lateral and medial sides of the outsole.

9. The golf shoe of claim 1, further comprising a plurality of triangular-shaped traction members extending along the lateral side of the outsole.

10. The golf shoe of claim 1, further comprising a plurality of grooves extending along the medial side of the outsole and adjacent to the traction members and substantially parallel to the flex channels.

11. The golf shoe of claim 1, wherein the outsole further includes a substantially rectangular-shaped groove in the arch area.

12. The golf shoe of claim 11, wherein the groove includes a visible logo.

13. The golf shoe of claim 1, wherein there is at least one set of anterior and posterior traction members with no flex channel disposed there between.

* * * * *